United States Patent [19]

Valentin

[11] Patent Number: 4,722,263

[45] Date of Patent: Feb. 2, 1988

[54] PORTABLE HYDRAULIC PUMP

[76] Inventor: Ingo Valentin, 15000 W. Cleveland, New Berlin, Wis. 53151

[21] Appl. No.: 850,856

[22] Filed: Apr. 11, 1986

[51] Int. Cl.[4] ..... F01B 31/00; F04B 19/02; F04B 9/02

[52] U.S. Cl. ..... 92/13.7; 92/58.1; 92/118; 417/234; 417/460; 417/903

[58] Field of Search ..... 417/234, 437, 440, 460, 417/461, 469, 903, 464, 470; 92/13, 13.7, 58.1, 118, 119

[56] References Cited

U.S. PATENT DOCUMENTS

| | | | |
|---|---|---|---|
| 565,893 | 8/1896 | Graefe | 92/118 X |
| 629,812 | 8/1899 | Peters | 92/118 X |
| 862,867 | 8/1907 | Eggleston | 417/390 |
| 878,367 | 2/1908 | Fecker et al. | 417/472 |
| 2,299,492 | 10/1942 | Pfauser | 417/440 X |
| 2,314,263 | 3/1943 | Witt | 92/58.1 |
| 2,495,319 | 1/1950 | Ferris et al. | 417/440 X |
| 2,711,571 | 6/1955 | Reischer | 417/903 |
| 2,820,415 | 1/1958 | Born | 417/437 |
| 2,885,961 | 5/1959 | Hopfeld | 92/13.7 X |
| 3,075,613 | 1/1963 | Williams | 92/13.7 X |
| 4,569,275 | 2/1986 | Brunet | 92/58.1 |

FOREIGN PATENT DOCUMENTS

| | | | |
|---|---|---|---|
| 674940 | 11/1963 | Canada | 417/234 |
| 593159 | 11/1977 | Switzerland | 417/234 |

*Primary Examiner*—Carlton R. Croyle
*Assistant Examiner*—Paul F. Neils
*Attorney, Agent, or Firm*—Michael, Best & Friedrich

[57] ABSTRACT

A combination hydraulic pump and integral container apparatus comprising a container including generally symmetrical first and second members coupled to each other for relative pivotal movement between a closed position wherein the members define a generally enclosed cavity and an open position wherein the members are angularly spaced, a hydraulic fluid reservoir contained within the cavity, and a pump for pumping fluid from the reservoir in response to movement of the members between the open and closed positions.

10 Claims, 14 Drawing Figures

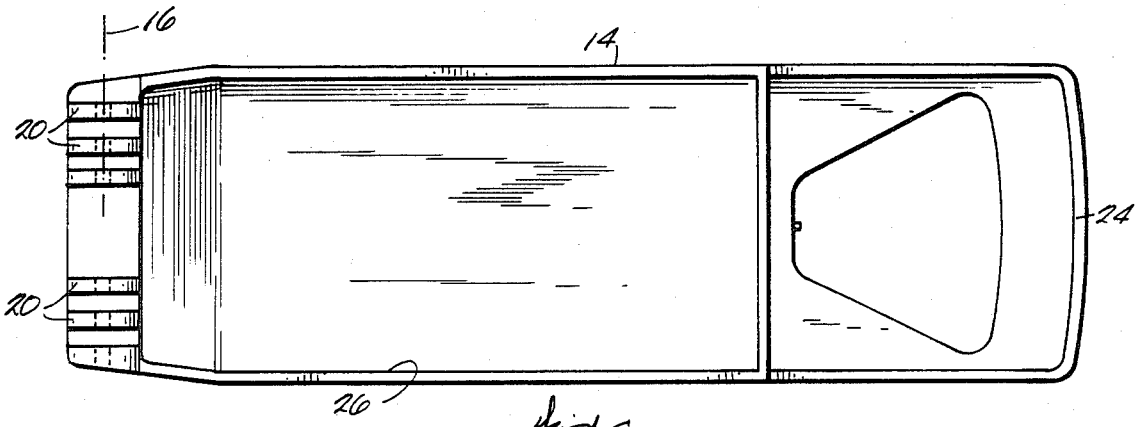
Fig. 6
Fig. 7
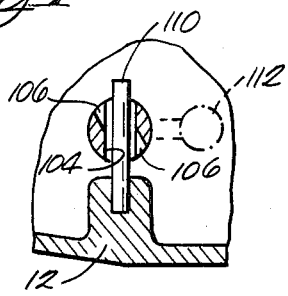
Fig. 8
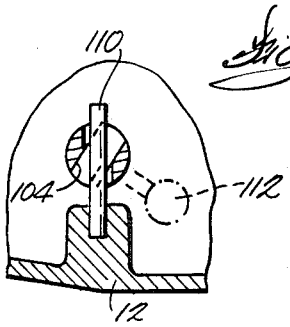
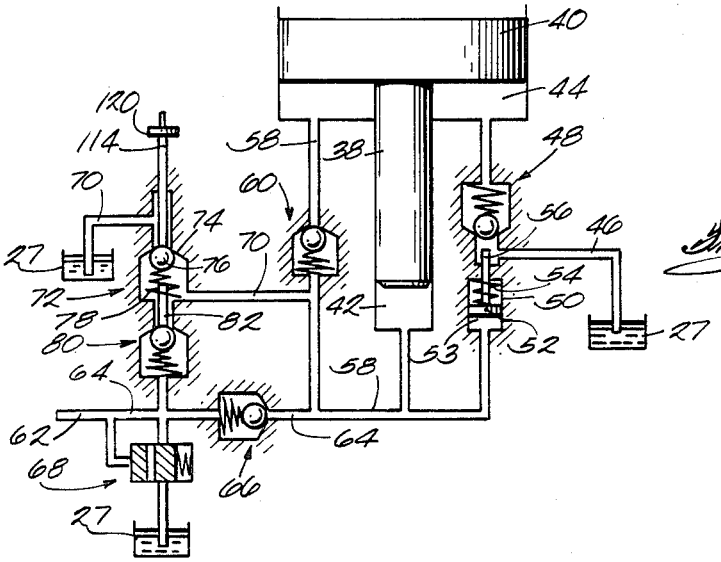
Fig. 11

PORTABLE HYDRAULIC PUMP

BACKGROUND OF THE INVENTION

The invention relates to portable hydraulic pumps.

Known portable hydraulic pumps are somewhat bulky or cumbersome. Therefore, they can be difficult or awkward to transport. Also, known portable hydraulic pumps can be damaged easily because they have some of their important components unprotected or exposed. Furthermore, known portable hydraulic pumps are usable either as a hand pump or as a foot pump, but not as both. The reason for this is that a foot pump requires a return spring causing the pumping member to return to its original position after it has been moved through its pumping stroke by the operator's foot. Such a return spring is undesirable in a hand pump because the pumping member can be returned by hand and the return spring simply requires additional effort from the operator in order to move the pumping member through its pumping stroke.

SUMMARY OF THE INVENTION

The invention provides a self-contained, portable hydraulic pump, or an apparatus which is a combination hydraulic pump and integral container.

The apparatus comprises a container constructed somewhat like a suitcase and including generally symmetrical first and second halves coupled to each other for relative pivotal movement between a closed position wherein the halves define a generally enclosed cavity and an open position wherein the halves are angularly spaced. Preferably, the two halves are identical aluminum pieces cast in the same mold. Furthermore, the halves are rectangular and each has an inner end pivotally connected to the inner end of the other half and an outer end including a handle for facilitating manual movement of the halves and handling of the container.

The apparatus also comprises a hydraulic fluid reservoir contained within the cavity defined by the halves. In the preferred embodiment, the reservoir is carried by and connected to one of the halves, but it extends outwardly of that half so that the reservoir extends into both halves of the container when the container is closed.

The apparatus further comprises a hydraulic pump contained within the cavity for pumping fluid from the reservoir in response to movement of the halves between the open and closed positions. In the preferred embodiment, the pump includes a cylinder connected to one of the halves for movement therewith, and a piston connected to the other of the halves for movement therewith. Preferably, the piston is connected to its associated half of the container at a point spaced a certain distance from the axis of pivotal movement of the container halves, and the apparatus also comprises means for adjusting that distance, thereby adjusting the mechanical advantage of the apparatus and the volume of the pumping chamber defined by the piston and the cylinder. Preferably, the apparatus can be set in an infinite number of positions between a high mechanical advantage/low volume setting and a low mechanical advantage/high volume setting.

In the preferred embodiment, the pump is a two-stage pump including high and low pressure pumping chambers which pump simultaneously. The pump also includes an inlet passage communicating between the reservoir and the low pressure pumping chamber, first check valve means located in the inlet passage for permitting fluid flow from the reservoir to the low pressure pumping chamber and for preventing fluid flow from the low pressure pumping chamber to the reservoir, and means for opening the first check valve means to permit fluid flow from the low pressure pumping chamber to the reservoir when the pressure in the high pressure pumping chamber exceeds a predetermined value. The pump further includes a first passage communicating between the low pressure pumping chamber and the high pressure pumping chamber, and second check valve means located in the first passage for permitting fluid flow from the low pressure pumping chamber to the high pressure pumping chamber and for preventing fluid flow from the high pressure pumping chamber to the low pressure pumping chamber.

The apparatus further comprises selectively engageable release means for permitting fluid flow from the pumping chamber to the reservoir, and selectively engageable return means for permitting fluid flow into the apparatus and back to the reservoir. In the preferred embodiment, the release means and the return means are interconnected so that the return means is operable only when the release means is operating.

The apparatus further comprises a release mechanism for selectively operating the release means regardless of the position of the container halves and for operating the return means when the container halves are in the closed position. In the preferred embodiment, the release mechanism includes an operator actuatable lever located beneath the handle of the upper container half.

The apparatus additionally comprises selectively engageable return means for biasing the container halves toward the open position. This allows use of the apparatus both as a foot pump and as a hand pump. When the return means is engaged, the apparatus can be used as a foot pump, and, when the return means is disengaged, the apparatus can be used as a hand pump.

The apparatus preferably further comprises a latch mechanism for releasably locking the members in the closed position so that the apparatus can be easily carried.

A principal feature of the invention is the provision of an apparatus which is a combination hydraulic pump and integral container. All of the important elements of the apparatus, the reservoir, the pump, and the return means, are contained within the container. This both prevents damage to these elements and also provides an attractive, portable unit.

Another principal feature of the invention is the provision of means for adjusting the mechanical advantage of the apparatus and the volume of the pumping chamber. This allows the operator to choose the output of the pump and the force necessary to operate the pump.

Another principal feature of the invention is the provision of selectively engageable return means. As explained above, this allows use of the apparatus both as a hand pump and as a foot pump.

Another principal feature of the invention is that the two container halves are identical. This reduces the cost of manufacturing the apparatus.

Another principal feature of the invention is the above-described two-stage pump, and particularly the means for opening the first check valve means when the pressure in the high pressure pumping chamber exceeds a predetermined value.

Another principal feature of the invention is the above-described return means and release means.

Another principal feature of the invention is the above-described release mechanism.

Other principal features and advantages of the invention will become apparent to those skilled in the art upon review of the following detailed description, claims, and drawings.

DESCRIPTION OF THE DRAWINGS

FIG. 6 is a top view of the lower container half.

FIG. 7 is a cross-sectional view taken along line 7—7 in FIG. 3.

FIG. 8 is a view similar to FIG. 7 showing the plunger in the engaged or second position.

FIG. 11 is a schematic diagram of the hydraulic circuit of the apparatus.

Figure 1:
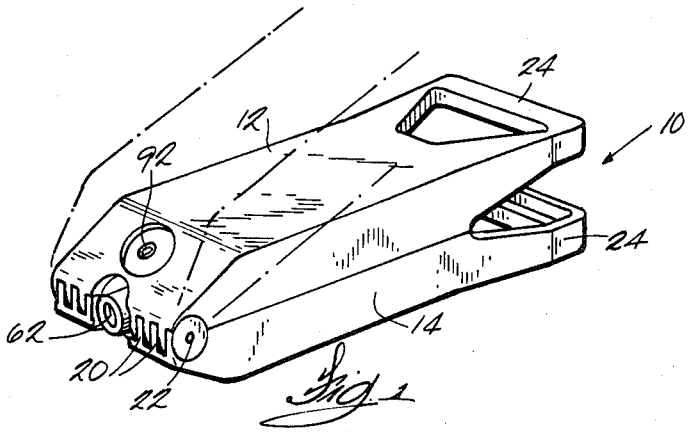
FIG. 1 is a perspective view of an apparatus embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An apparatus 10 which embodies various of the features of the invention is illustrated in the drawings. As best shown in FIG. 1, the apparatus 10 is a combination hydraulic pump and integral container and comprises a suitcase-like container including generally symmetrical first and second members or upper and lower halves 12 and 14, respectively, coupled to each other for relative pivotal movement about a pivot axis 16. The halves 12 and 14 are movable between a closed position (solid lines in FIG. 1) wherein the halves define a generally enclosed cavity 18 and an open position (dotted lines in FIG. 1) wherein the halves are angularly spaced. In the preferred embodiment, the two halves 12 and 14 are identical pieces of aluminum case from the same mold.

Figure 2:
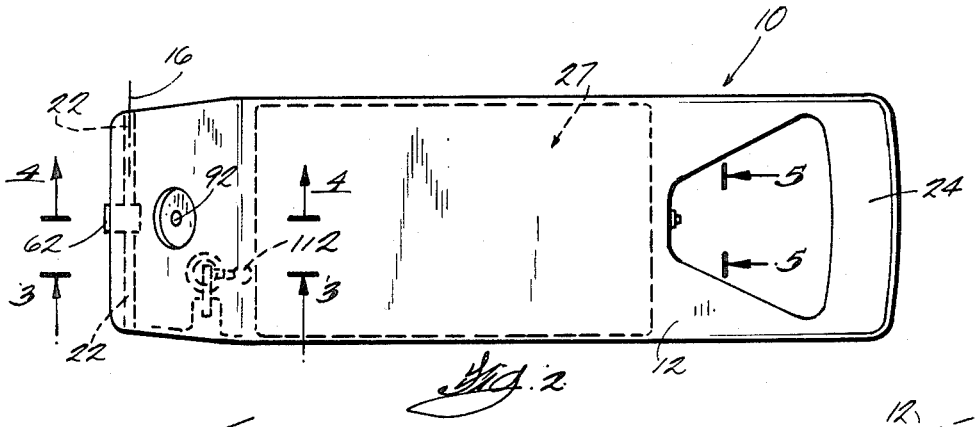
FIG. 2 is a top view of the apparatus.

As shown in FIG. 6, each half is generally rectangular and has an inner or left end and an outer or right end. The inner ends include a plurality of alternating projections 20 pivotally connected by a pair of hinge pins 22 (FIGS. 2 and 3) extending along the pivot axis 16. The outer ends include integral handles 24 for facilitating manual reciprocation of the halves 12 and 14 and handling of the container. Each half also includes an outer side and an inner side. The outer sides form the outside of the container. Each inner side has therein a generally rectangular recess 26 which partially defines the cavity 18. The recesses 26 are aligned so that they define the enclosed cavity 18 when the halves 12 and 14 are in the closed position.

Figure 5:
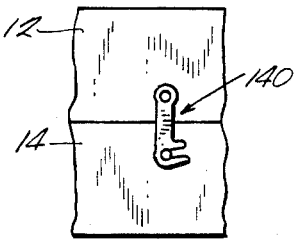
FIG. 5 is a view taken along line 5—5 in FIG. 2.

The apparatus 10 also comprises a latch mechanism 140 (FIG. 5) for releasably locking the container halves in the closed position.

The apparatus 10 also comprises a hydraulic fluid reservoir 27 contained within the cavity 18. While various suitable reservoirs can be employed, in the preferred embodiment, the reservoir 27 includes (see FIG. 4) a generally rectangular plastic bottle 28 contained within the outer portion (toward the outer ends of the halves) of the cavity 18. In the illustrated construction, the bottle 28 is carried with and connected to the lower half 14 of the container. The bottle 28 can be connected to the lower half by any suitable means (not shown). The bottle 28 extends upwardly or outwardly from the recess 26 in the lower half 14 so that, when the container halves are in the closed position, the bottle 28 extends into the recess 26 in the upper half 12 and substantially fills the cavity 18. The bottle 28 has therein an aperture 30, the reason for which is explained hereinafter.

The reservoir 27 also includes a flexible, collapsible bladder 32 contained within the bottle 28. The bladder 32 contains hydraulic fluid and, when full, fills the bottle 28. As hydraulic fluid is removed from the bladder 32, the bladder 32 collapses within the bottle 28. The above-mentioned aperture 30 allows air to enter the bottle 28 as the bladder 32 collapses so that the bottle 28 does not also collapse.

The apparatus 10 also comprises means contained within the cavity 18 for pumping fluid from the reservoir 27 in response to movement of the members 12 and 14 between the open and closed positions. More particularly, the pumping means operates in response to reciprocal movement of the container halves between the open and closed positions.

Figure 4:
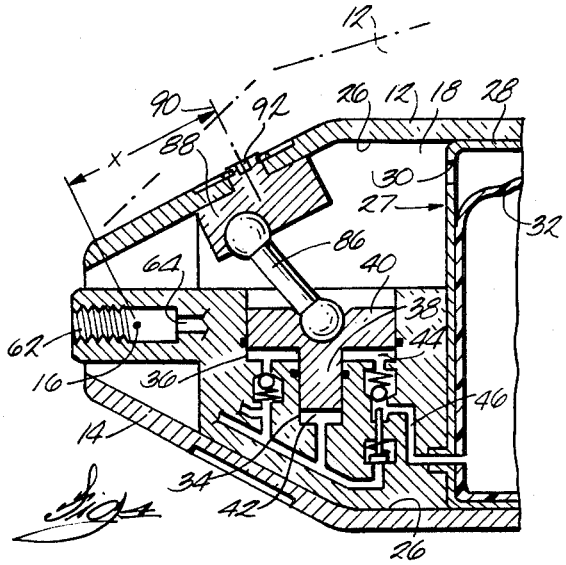
FIG. 4 is a cross-sectional view taken along line 4—4 in FIG. 2.

While various suitable pumping means can be used, in the illustrated construction, as shown in FIGS. 4 and 11, the pumping means is a two-stage pump including a high pressure cylinder 34 and a low pressure cylinder 36 both connected to the lower half 14 of the container for movement therewith, and a high pressure piston 38 and a low pressure piston 40 both connected to the upper half 12 of the container for movement therewith. The high pressure piston 38 is slidably received in the high pressure cylinder 34 and cooperates with the high pressure cylinder 34 to define a high pressure pumping chamber 42 communicating with the reservoir 27. The low pressure piston 40 is slidably received in the low pressure cylinder 36 and cooperates with the low pressure cylinder 36 to define a low pressure pumping chamber 44 also communicating with the reservoir 27. The volumes of both pumping chambers are determined by the positions of the respective pistons in their respective cylinders. In the preferred embodiment, the pumping means also includes means connecting the high pressure piston 40 to the low pressure piston 38 for common movement. Preferably, both pistons are formed by a unitary piston member connected to the upper half 12 of the container for movement therewith.

The pumping means further includes an inlet passage 46 communicating between the reservoir 27 and the low pressure pumping chamber 44, and first check valve means 48 located in the inlet passage 46 for permitting fluid flow from the reservoir 27 to the low pressure pumping chamber 44 and for preventing fluid flow from the low pressure pumping chamber 44 to the reservoir 27. The pumping means also includes means for opening the first check valve means 48 to permit fluid flow from the low pressure pumping chamber 44 to the reservoir 27 when the pressure in the high pressure pumping chamber 42 exceeds a first predetermined value. In the illustrated construction, this opening means includes a cylinder 50, a piston 52 slidably received in the cylinder 50 and cooperating with the cylinder 50 to define a chamber 53 communicating with the high pressure pumping chamber 42, and a spring 54 biasing the piston 52 in the direction minimizing the volume of the chamber 53 so that the force exerted by the spring 54 opposes the pressure exerted by the fluid in the high pressure pumping chamber 42. The force of the spring 54 is such that when the pressure in the high pressure pumping chamber 42 exceeds the first predetermined value, the piston 52 is moved in the direction maximizing the volume of the chamber 53. The means for opening the first check valve means 48 also includes a plunger 56 connected to the piston 52 so that the plunger 56 opens the first check valve means 48 when the piston 52 moves in the direction maximizing the volume of the chamber 53.

The pumping means also includes a first passage 58 communicating between the low pressure pumping chamber 44 and the high pressure pumping chamber 42. The pumping means also includes second check valve means 60 located in the first passage 58 for permitting fluid flow from the low pressure pumping chamber 44 to the high pressure pumping chamber 52 and for preventing fluid flow from the high pressure pumping chamber 42 to the low pressure pumping chamber 44.

The pumping means also includes an internally threaded outlet fixture extending from the inner end of the container and defining an outlet 62, and an outlet passage 64 communicating between the pumping chambers and the outlet 62. In the preferred embodiment, the outlet passage 64 communicates with the first passage 58 downstream of the second check valve means 60. The outlet passage 64 has therein third check valve means 66 for permitting fluid flow from the first passage 58 to the outlet 62 and for preventing fluid flow from the outlet 62 to the first passage 58.

The pumping means also includes relief valve means 68 (FIG. 11) for permitting fluid flow from the outlet passage 64 to the reservoir 27 when the pressure of the fluid in the outlet passage 64 exceeds a second predetermined value.

The pumping means operates as follows. When the container halves 12 and 14 are in the closed position, the volumes of the pumping chambers are at a minimum. As the container halves are moved from the closed position toward the open position, the volumes of the pumping chambers increase and this causes fluid flow from the reservoir 27 to the low pressure pumping chamber 44 through the inlet passage 46, as well as fluid flow from the low pressure pumping chamber 44 to the high pressure pumping chamber 42 through the first passage 58. During this intake stroke, the third check valve means 66 prevents fluid flow into the pumping chambers from the outlet passage 64. When the container halves are in the open position, the volumes of the pumping chambers are at a maximum, and the pumping chambers are full of fluid. Subsequent movement of the container halves from the open position toward the closed position reduces the volumes of the pumping chambers and this causes fluid to flow out of the pumping chambers through the outlet passage 64. During this pumping stroke, the first check valve means 48 prevents fluid flow from the low pressure pumping chamber 44 to the reservoir 27, and the second check valve means 60 prevents fluid flow from the high pressure pumping chamber 42 to the low pressure pumping chamber 44.

Whenever, during operation of the pumping means, the pressure in the high pressure pumping chamber 42 exceeds the first predetermined value, this pressure causes the plunger 56 to open the first check valve means 48 so that during the pumping stroke fluid flows out of the low pressure pumping chamber 44 through the inlet passage 46 into the reservoir 27. Accordingly, when the pressure exceeds the first predetermined valve, only the high pressure piston 38 pumps fluid. The second check valve means 60 continues to prevent fluid flow from the high pressure pumping chamber 42 to the low pressure pumping chamber 44.

If for some reason the fluid pressure in the outlet passage 64 becomes too high, i.e., exceeds the above-mentioned second predetermined value, the relief valve means 68 opens and permits the fluid to return to the reservoir 27.

The apparatus 10 further comprises selectively engageable release means for permitting fluid flow from the pumping chambers (specifically from the first passage 58 downstream of the second check valve means 60) to the reservoir 27. While various suitable release means can be employed, in the preferred embodiment, such means includes (see FIG. 11) a second passage 70 communicating between the first passage 58 and the reservoir 27, release valve means 72 normally preventing fluid flow through the second passage 70, and means for selectively opening the release valve means 72 to permit fluid flow through the second passage 70. In the illustrated construction, the release valve means 72 includes a valve seat 74, a ball 76 engageable with the valve seat 74, and a spring 78 biasing the ball 76 against the valve seat 74. The ball 76 is movable away from the valve seat 74 to a first position, and to a second position in which the ball 76 is further away from the valve seat 74 than in the first position. The release valve means 72 is engaged by moving the ball 76 away from the valve seat 74. This is done with a release mechanism 84 described hereinafter.

The apparatus 10 further comprises selectively engageable return means for permitting fluid flow from the outlet 62 to the reservoir 27. While various suitable return means can be employed, in the preferred embodiment, the return means includes (see FIG. 11) return valve means 80 communicating between the outlet passage 64 and the second passage 70. The return valve means 80 normally prevents fluid flow from the outlet passage 64 to the second passage 70. Preferably, the return valve means 80 communicates with the second passage 70 upstream of the release valve means 72 so that the return valve means 80 is operable only when the release valve means 72 is open. The return means also includes means for selectively opening the return valve means 80. This means includes a plunger 82 for opening the return valve means 80. The plunger 82 is located adjacent the ball 76 of the release valve means 72 so that the ball 76 does not engage the plunger 82 when the ball 76 is in the first position, but the ball 76 engages the plunger 82 to open the return valve means 80 when the ball 76 is in the second position.

If at some point the operator finds it difficult or impossible, due to high pressure at the outlet 62, to move the container halves to the closed position, i.e., to move the piston member through its pumping stroke, the operator can engage the release means. When this is done, fluid flows from the first passage 58 through the second passage 70 to the reservoir 27, and the operator does not have to fight the pressure in the outlet passage 64.

When the operator desires to return the fluid to the reservoir 27, the operator engages the return valve means 80. This is done by moving the ball 76 of the release valve means 72 to the second position, so that both the release valve means 72 and the return valve means 80 are open. The ball 76 is moved to the second position by the above-mentioned and below-described release mechanism 84. Opening of the return valve means 80 permits fluid flow from the outlet 62 through the return valve means 80, the release valve means 72 and the second second passage 70 to the reservoir 27.

As mentioned above, the apparatus 10 further comprises a release mechanism 84 for selectively moving the ball 76 of the release valve means 72 to the first or second positions, thereby respectively opening either (a) the release valve means 72 only, or (b) both the release valve means 72 and the return valve means 80. While various suitable release mechanisms can be employed, in the preferred embodiment, the release mechanism 84 includes (see FIGS. 9–14) a release plunger 114 slidably received in a housing 116 fixed to the lower container half 14. The plunger 114 has an inner end engageable with the ball 76 and an outer end extending outwardly of the housing 116. The plunger 114 also includes (see FIGS. 12–14) a reduced-diameter portion forming a shoulder 118 (FIG. 14) located near the outer end and outwardly of the housing 116. Inward or downward movement of the plunger 114 causes movement of the ball 76 away from the valve seat 74.

The release mechanism 84 also includes a ring 120 slidably received on the reduced-diameter portion of the plunger 114. Downward movement of the ring 120 causes the ring 120 to engage the shoulder 118 and thereby move the plunger 114 downwardly. Downward movement of the ring 120 to the position in which the ring 120 engages the housing 116 moves the plunger 114 to the first position (in which the ball 76 is in the first position). Because the ring 120 is slidably received on the plunger 114, the plunger 114 can also move downwardly relative to the ring 120. Therefore, when the ring 120 engages the housing 116, the plunger 114 can be moved further downwardly to the second position (in which the ball 76 is in the second position).

The release mechanism 84 also includes selectively engageable first means for moving the plunger 114 to the first position regardless of the relative positions of the container halves. Alternatively, this is selectively engageable means for opening the release valve means 72 regardless of the relative positions of the container halves. While various suitable means can be employed, in the preferred embodiment, the first moving means includes an L-shaped rocker arm 122 mounted on the lower half 14 for pivotal movement about a generally horizontal axis 123. The rocker arm 122 has first and second ends. The first end is engageable with the ring 120 for moving the ring 120 downwardly into engagement with the housing 116 (to move the plunger 114 to the first position). The rocker arm 122 is movable between a first position (shown in FIG. 12) wherein the first end of the rocker arm 122 does not move the ring 120 downwardly, and a second position (shown in FIGS. 13 and 14) wherein the first end of the rocker arm 122 moves the ring 120 downwardly.

The first moving means also includes a plate-like lever 124 located adjacent the rocker arm 122 and including a first end mounted on the lower half 14 for pivotal movement about a generally vertical axis 125, and a second end engageable with the second end of the rocker arm 122 for moving the rocker arm 122 to its second position. The lever 124 is movable between a first position wherein the second end of the lever 124 does not move the rocker arm 122, and a second position wherein the second end of the lever 124 moves the rocker arm 122 to its second position.

Figure 12:
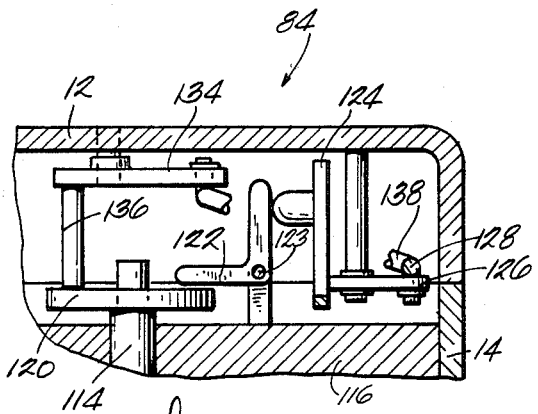
FIG. 12 is a view taken along line 12—12 in FIG. 9.
Figure 13:
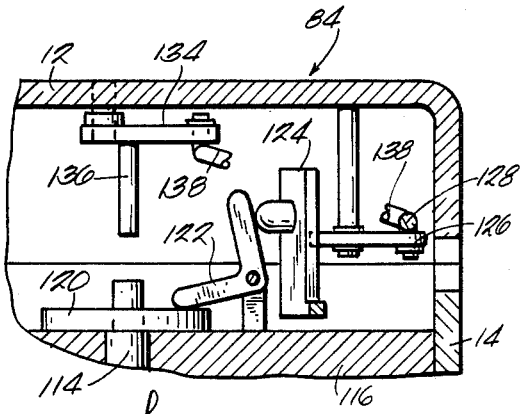
FIG. 13 is a view similar to FIG. 12 showing the container halves in the open position and the release plunger in the release position.
Figure 14:
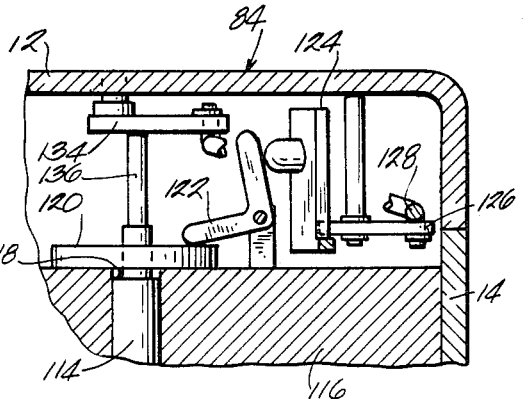
FIG. 14 is a view similar to FIG. 12 showing the container halves in the closed position and the release plunger in the return position.

The first moving means also includes a cam member 126 mounted on the upper half 12 for pivotal movement about a generally vertical axis 127 (when the upper half 12 is in the closed position). The cam member 126 includes a surface engageable with the lever 124, and the cam member 126 is movable between a first position wherein the surface does not move the lever 124, and a second position wherein the surface moves the lever 124 to its second position. It should be noted that the cam member 126 moves upwardly and downwardly with the upper half 12 relative to the lower half 14. However, because of the vertical extent of the lever 124, the cam member 126 is engageable with the lever 124 regardless of the position of the upper half 12 relative to the lower half 14. In FIGS. 12 and 14, the cam member 126 is shown in its position when the container halves are in the closed position. In FIG. 13, the cam member 126 is shown in its position when the container halves are in the open position.

The first moving means further includes a rod 128 connected to the cam member 126 at a point spaced from the pivot axis of the cam member 126. The rod 128 extends in the direction of the longitudinal axis of the container, and movement of the rod 128 toward the outer end of the container causes pivotal movement of the cam member 126 to its second position.

Figure 9:
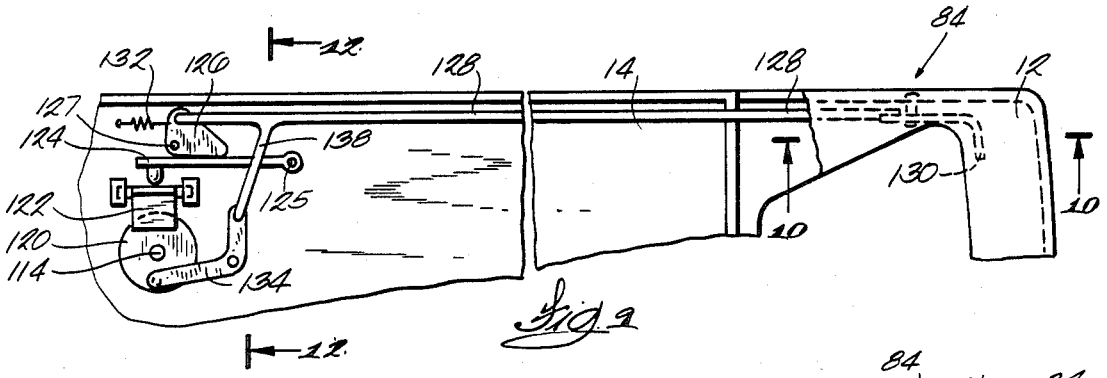
FIG. 9 is a partial top view of the apparatus.
Figure 10:
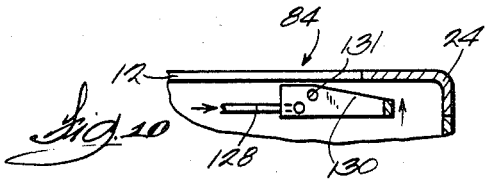
FIG. 10 is a cross-sectional view taken along line 10—10 in FIG. 9.

The first moving means further includes an operator actuatable lever 130 (see FIGS. 9 and 10) for moving the rod 128 toward the outer end of the container, thereby moving the cam member 126 to its second position. In the preferred embodiment, the lever 130 is mounted inside and beneath the handle 24 on the upper half 12 of the container, as shown in FIGS. 9 and 10. The lever 130 rotates about a generally horizontal axis 131 and is located so that it can easily be squeezed to move the rod 128 toward the outer end of the container.

The first moving means further includes a spring 132 (FIG. 9) connected to the upper half 12 of the container and biasing the cam member 126 toward its first position, thereby acting through the rod 128 to bias the lever 130 against operator actuation. Accordingly, if the lever 130 is not being squeezed by the operator, the cam member 126 will move to its first position, and the rocker arm 122 will not move the ring 120 downwardly to move the plunger 114 to its first position.

The release mechanism 84 further includes selectively engageable second means for moving the plunger 114 to its second position when the container halves are in the closed position. While various suitable means can be used, in the illustrated construction, this second moving means includes (see FIGS. 12–14) an L-shaped rocker arm 134 mounted on the upper half 12 for pivotal movement about a generally vertical axis. The rocker arm 134 is pivotally movable between first and second positions. The rocker arm 134 has a first end, and a second end including a downwardly extending projection 136 engageable with the outer end of the plunger 114 to move the plunger 114 to its second position. When the container halves are in the open position (FIG. 13), the projection 136 is located above the outer end of the plunger 114. When the rocker arm 134 is in its first position (FIG. 12), the projection 136 is out of vertical alignment with the plunger 114 so that the projection 136 does not engage the outer end of the plunger 114 when the container halves are moved to the closed position. When the rocker arm 134 is in its second position (FIG. 14), the projection 136 is vertically aligned with the plunger 114 so that it engages the outer end of the plunger 114 to move the plunger 114 to its second position when the container halves are in the closed position.

The second moving means also includes means connecting the rocker arm 134 to the lever 130 for moving the rocker arm 134 to its second position when the lever 130 is actuated or squeezed by the operator. In the preferred embodiment, this connecting means includes an extension 138 (FIG. 9) of the rod 128 connected to the first end of the rocker arm 134. When the lever 130 is squeezed and the rod 128 moves toward the outer end of the container, the rod extension 138 moves the rocker arm 134 to its second position. Therefore, when the lever 130 is squeezed and the container is closed, both the release valve means 72 and the return valve means 80 are open.

In the preferred embodiment, as shown in FIG. 4, the piston member is connected to the upper member or half 12 at a point spaced a given distance "x" from the pivot axis 16. This distance determines the mechanical advantage of the apparatus 10 and also the maximum volumes of the pumping chambers. Increasing the distance decreases the mechanical advantage of the apparatus and increases the maximum volumes of the pumping chambers, and decreasing the distance increases the mechanical advantage of the apparatus and decreases the maximum volumes of the pumping chambers. When the distance is increased, the maximum volumes are increased because the height of the pistons within the cylinders is increased.

In the illustrated construction, the piston member is connected to the upper half 12 by a piston rod 86 having a lower end connected to the piston member by a ball and socket joint, and an upper end connected to the upper half 12 by a ball and socket joint. Preferably, the upper half 12 includes a disc 88 which is rotatable about an axis 90 generally perpendicular to the pivot axis 16, and the upper end of the piston rod 86 is connected to the disc 88 at a point spaced from this axis 90.

The apparatus 10 further comprises means for adjusting the distance "x". While various suitable adjusting means can be employed, in the preferred embodiment, the adjusting means includes means for rotating the disc 88. In the illustrated construction, the disc 88 includes a socket 92 extending through the outer side of the upper half, and the socket 92 is engageable by an Allen wrench for rotating the disc 88. The disc 88 is rotatable to an infinite number of positions between a high mechanical advantage/low volume position and a low mechanical advantage/high volume position.

Figure 3:
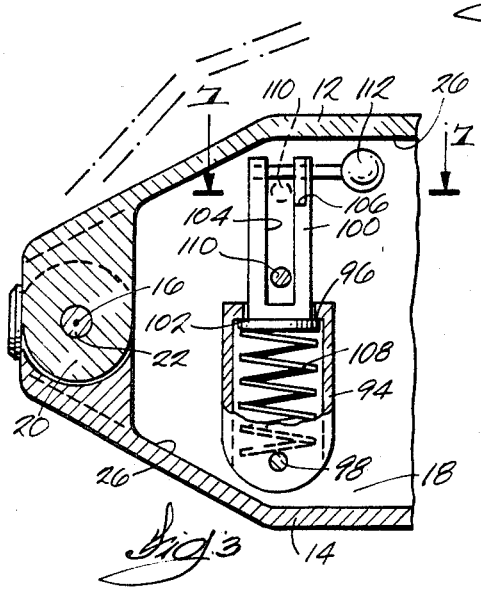
FIG. 3 is a cross-sectional view taken along line 3—3 in FIG. 2.

The apparatus 10 further comprises selectively engageable means for biasing the container halves toward the open position. The biasing means can be engaged to permit use of the apparatus 10 as a foot pump and can be disengaged to facilitate use of the apparatus 10 as a hand pump. While various suitable biasing means can be used, in the illustrated construction, the biasing means includes (see FIGS. 3, 7 and 8) a first element or cylinder 94 pivotally mounted on the lower half 14 of the container. As best shown in FIG. 3, the cylinder 94 has an open upper end including a shoulder 96, and a lower end pivotally connected to the lower half 14 of the container by a pin 98. The biasing means also includes a second element or plunger 100 rotatably received in the cylinder 94. The lower end of the plunger 100 includes a flange portion 102 which is engageable with the shoulder 96 for preventing removal of the plunger 100 from the cylinder 94. The plunger 100 has therein a longitudinally extending slot 104 and a pair of cut-out portions or shelves 106 adjacent the slot 104. The reason for the shelves 106 is explained hereinafter.

The biasing means also includes means for exerting on the plunger 100 a force biasing the plunger 100 upwardly or away from the cylinder 94 or lower half 14 of the container. Preferably, this means includes a spring 108 located within the cylinder 94 between the lower end of the cylinder 94 and the lower end of the plunger 100. The spring 108 biases the plunger 100 to the position in which the flange portion 102 of the plunger 100 engages the shoulder 96 on the cylinder 94. The biasing means also includes means for selectively transmitting the force acting on the plunger 100 to the upper half 12 of the container, thereby biasing the container halves to the open position. In the preferred embodiment, this selective transmitting means includes a pin 110 fixedly mounted on the upper half 12 of the container and extending through the slot 104 in the plunger 100. Upward movement of the pin 110 in the slot 104 is limited by an adjustment rod 112 which extends through the upper end of the plunger 100 and which closes the upper end of the slot 104. Lateral movement of the adjustment rod 112 causes rotation of the plunger 100. When the container halves are in the open position, the pin 110 engages the adjustment rod 112.

As best shown in FIGS. 7 and 8, the plunger 100 can be rotated (with the adjustment rod 112) between a first or disengaged position wherein the pin 110 extends parallel to the walls of the slot 104, and a second or engaged position wherein the pin 110 extends above the shelves 106. When the plunger 100 is in the first position, the pin 110 moves freely along the length of the slot 104 when the upper half 12 is moved relative to the lower half 14 and the force exerted by the spring 108 on the plunger 100 is not transmitted to the upper half of the container. When the plunger 100 is in the second position, downward movement of the upper half of the container causes the pin 110 to engage the shelves 106, and subsequent movement of the container halves toward the closed position causes the plunger 100 to move downwardly in the cylinder 94, thereby compressing the spring 108. Therefore, the spring 108 biases the plunger 100 upwardly and thereby biases the container halves toward the open position.

Various other features and advantages of the invention are set forth in the following claims.

I claim:

1. A hydraulic pump apparatus comprising first and second members connected to each other for relative pivotal movement between a closed position and an open position wherein said members are angularly spaced, a hydraulic fluid reservoir, means for pumping fluid from said reservoir in response to movement of said members between said open and closed positions, and selectively engageable means for biasing said members toward said open position, whereby said biasing means can be engaged to permit use of said apparatus as a foot pump and can be disengaged to facilitate use of said apparatus as a hand pump.

2. An apparatus as set forth in claim 1 and further comprising means for releasably locking said members in said closed position.

3. An apparatus set forth in claim 1 and further comprising handle means located on one of said members.

4. An apparatus as set forth within claim 1 wherein said biasing means includes a first element fixed to one of said members, a second element, means for exerting on said second element a force biasing said second element away from said first element, and means for selectively transmitting said force to the other of said members, thereby biasing said members to said open position.

5. An apparatus as set forth in claim 15 wherein said biasing means includes an element, means for exerting on said element a force biasing said element away from one of said members, and means for selectively transmitting said force to the other of said members, thereby biasing said members to said open position.

6. A combination hydraulic pump and integral container apparatus comprising a container including generally symmetrical first and second members coupled to each other for relative pivotal movement between a closed position wherein said members define a generally enclosed cavity and an open position wherein said members are angularly spaced, a hydraulic fluid reservoir container within said cavity, means contained within said cavity for pumping fluid from said reservoir in response to movement of said members between said open and closed positions, said pumping means including a cylinder connected to one of said members for movement therewith, and a piston connected to the other of said members for movement therewith, said piston being connected to said other of said members at a point spaced a distance from said axis, and said piston being slidably received in said cylinder and cooperating with said cylinder to define a pumping chamber communicating with said reservoir and having a volume, means for adjusting said distance, thereby adjusting the mechanical advantage of said apparatus and the volume of said pumping chamber, and selectively engageable means for biasing said members toward said open position, whereby said biasing means can be engaged to permit use of said apparatus as a foot pump and can be disengaged to facilitate use of said apparatus as a hand pump.

7. An apparatus as set forth within claim 6 wherein said biasing means includes a first element mounted on one of said members, a second element, means for exerting on said second element a force biasing said second element away from said first element, and means for selectively transmitting said force to the other of said members, thereby biasing said members to said open position.

8. An apparatus as set forth in claim 6 and further comprising means for releasably locking said members in said closed position.

9. An apparatus as set forth in claim 6 wherein said container includes handle means located on one of said members.

10. An apparatus as set forth in claim 6 wherein each of said members has an inner end pivotally connected to the inner end of the other of said members, and an outer end opposite said inner end, and wherein each of said members includes handle means located on said outer end for facilitating manual reciprocation of said members and handling of said container.

* * * * *